US009765558B2

(12) United States Patent
Talpe

(10) Patent No.: US 9,765,558 B2
(45) Date of Patent: Sep. 19, 2017

(54) DEVICE FOR CLOSING A HINGED MEMBER

(71) Applicant: LOCINOX, Waregem (BE)

(72) Inventor: Joseph Talpe, Heestert-Zwevegem (BE)

(73) Assignee: LOCINOX, Waregem (BE)

( * ) Notice: Subject to any disclaimer, the term of this patent is extended or adjusted under 35 U.S.C. 154(b) by 0 days.

(21) Appl. No.: 15/192,458

(22) Filed: Jun. 24, 2016

(65) Prior Publication Data

US 2016/0376824 A1 Dec. 29, 2016

(30) Foreign Application Priority Data

Jun. 26, 2015 (EP) ..... 15174172

(51) Int. Cl.
*E05F 3/10* (2006.01)
*E05F 1/10* (2006.01)

(52) U.S. Cl.
CPC ..... *E05F 3/102* (2013.01); *E05F 3/10* (2013.01); *E05F 3/108* (2013.01); *E05F 1/105* (2013.01);
(Continued)

(58) Field of Classification Search
CPC ... E05F 3/102; E05F 3/10; E05F 3/108; E05F 1/105; Y10T 16/27; Y10T 16/276;
(Continued)

(56) References Cited

U.S. PATENT DOCUMENTS 3,028,620 A * 4/1962 Quinn ..... E05F 3/108 16/52
3,057,004 A * 10/1962 Sogoian ..... E05F 3/108 137/513.3

(Continued)

FOREIGN PATENT DOCUMENTS

EP 1845226 A1 10/2007
WO 2011023793 A1 3/2011

OTHER PUBLICATIONS

Communication dated Dec. 7, 2015, from the European Patent Office in counterpart European application No. 15174172.5.

*Primary Examiner* — Jeffrey O Brien
(74) *Attorney, Agent, or Firm* — Sughrue Mion, PLLC

(57) ABSTRACT

A closing device includes an actuator mechanism and a hydraulic damper mechanism. The actuator mechanism includes a pushrod urged by a resilient member towards its extended position. The hydraulic damper mechanism includes a piston, a first rack and pinion gearing for converting the translational motion of the pushrod into a rotational motion of a first pinion, a transmission, which includes a second rack and pinion gearing, between the first pinion and the piston for transmitting and converting the rotational motion of the first pinion into a translational motion of the piston, a one-way valve allowing fluid flow from a first side to a second side of the cylinder cavity when opening the hinged member, and a restricted fluid passage between the first and second sides of the cylinder cavity. The transmission provides together with the pinions of the first and second rack and pinion gearings a reduction gearing between the pushrod and the piston so that the piston reciprocates over a smaller distance than the pushrod.

17 Claims, 9 Drawing Sheets

(52) U.S. Cl.
CPC ... *E05Y 2201/686* (2013.01); *E05Y 2201/716* (2013.01); *E05Y 2201/722* (2013.01); *E05Y 2800/122* (2013.01); *E05Y 2900/132* (2013.01); *E05Y 2900/40* (2013.01); *Y10T 16/27* (2015.01); *Y10T 16/2788* (2015.01)

(58) Field of Classification Search
CPC ..... Y10T 16/2766; Y10T 16/2777; Y10T 16/2788; Y10T 16/2793; Y10T 16/2804; Y10T 16/56; Y10T 16/577; Y10T 16/62
See application file for complete search history.

(56) References Cited

U.S. PATENT DOCUMENTS 4,675,938 A * 6/1987 Bundschuh ..... E05F 1/16 16/63
5,048,151 A * 9/1991 Orii ..... E05F 3/00 16/49
5,259,090 A * 11/1993 Fayngersh ..... E05F 3/102 16/51
6,336,294 B1 * 1/2002 Kowalczyk ..... E05D 15/54 49/339
6,694,674 B2 * 2/2004 Son ..... E05F 3/14 49/139
7,971,316 B2 * 7/2011 Copeland, II ..... E05F 3/12 16/79
8,415,902 B2 * 4/2013 Burris ..... E05F 3/102 16/52
8,468,650 B2 * 6/2013 Talpe ..... F16F 9/19 16/54
8,527,101 B2 * 9/2013 Burris ..... E05F 3/102 16/71
8,567,011 B2 * 10/2013 Talpe ..... F16F 9/19 16/50
8,773,237 B2 * 7/2014 Burris ..... G05B 19/0426 16/49
8,779,713 B2 * 7/2014 Burris ..... E05F 3/22 318/264
9,410,352 B2 * 8/2016 Lee ..... E05F 3/102
9,410,353 B2 * 8/2016 Lee ..... E05F 3/102
9,500,018 B2 * 11/2016 Miglioranzo ..... E05F 3/102
2002/0133904 A1 * 9/2002 Donovan ..... E05F 3/16 16/49
2003/0097794 A1 * 5/2003 Brennwald ..... E05F 1/105 49/336
2004/0034968 A1 * 2/2004 Williams ..... E05D 3/122 16/354
2009/0107051 A1 * 4/2009 Talpe ..... E05F 15/619 49/386
2011/0214354 A1 * 9/2011 Talpe ..... E05F 15/63 49/324
2015/0211278 A1 * 7/2015 Moyer ..... E05F 3/102 16/52
2015/0218867 A1 * 8/2015 Ishida ..... E05F 3/10 16/62
2016/0186476 A1 * 6/2016 Held ..... E05C 19/165 49/263

* cited by examiner

DEVICE FOR CLOSING A HINGED MEMBER

CROSS-REFERENCE TO RELATED APPLICATION

This application claims priority from European Patent Application No. 15174172.5 respectively filed Jun. 26, 2015 the disclosures of which are incorporated herein by reference in their entireties.

BACKGROUND OF THE INVENTION

Field of the Invention

The present invention relates to a device for closing a closure member hinged on a support, which closing device comprises an actuator mechanism having a resilient member which is arranged to urge the hinged closure member towards its closed position and a hydraulic damper mechanism for damping the closing movement of said hinged closure member under the action of said resilient member.

Background

The actuator mechanism comprises a frame, a reciprocating pushrod which is slidably mounted on said frame to translate between an extended and a retracted position when opening and closing the hinged member, and the resilient member which is arranged between said pushrod and said frame to urge the pushrod towards its extended position. The hydraulic damper mechanism comprises a cylinder barrel defining a closed cylinder cavity, a reciprocating piston placed within said cylinder barrel so as to divide the cylinder cavity into a first side and a second side, a first motion converting mechanism for converting the translational motion of said pushrod into a rotational motion of a first pinion, which first motion converting mechanism comprises a first rack and pinion gearing having a first rack on said pushrod which engages said first pinion, a transmission, including a second motion converting mechanism, between said first pinion and said piston for transmitting and converting the rotational motion of said first pinion into a translational motion of the piston, a one-way valve allowing fluid flow from said first side to said second side of the cylinder cavity when opening the hinged member, and at least one restricted fluid passage between said first and second sides of the cylinder cavity.

Such a closing device, which shows all of the features of the preamble of claim 1, is disclosed in WO 2011/023793 and is offered for sale by the applicant under the name Samson. The Samson closing device or gate closer is intended for outdoor use, more particularly for closing gates or doors, such as garden or industrial gates or doors. The closing device is hingedly mounted, on the one hand, on the closure member and, on the other hand, on the support of the closure member so that when opening the closure member the pushrod of the closing device is pushed in and the resilient member, which is formed by a compression spring, compressed whilst when the closure member is released it is automatically closed by the pushrod which is pushed out again by the relaxing compression spring.

A problem with closing devices which are mounted in such a way is that the distance over which the pushrod is pushed in when opening the closure member over for example 90° dependents on the position of the hinge axis of the hinged closure member with respect to the position of the hinge axis of the closing device on the support. These positions may vary for example as a result of the diameter or thickness of the support and also as a result of the type of hinge, i.e. whether the hinge axis is situated between the support and the hinge member, for example for so-called 90° hinges, or whether the hinge axis is situated at a distance in front of the support and the hinged member, for example for so-called 180° hinges. The position of the different hinge axes also depends of course on the relative positions wherein the hinged closure member and the closing device are mounted on the support.

To ensure a correct functioning of the closing device in a broad range of different situations, the maximum stroke of the pushrod should be quite large and is for the prior art Samson gate closer equal to about 140 mm. An advantage of such a large stroke is that a quite long but relatively weak resilient member can be used, i.e. a resilient member with a relatively low spring constant, so that a smaller force needs to be exerted onto the resilient member to store a same amount of energy therein. In other words, less stresses are exerted onto the components of the closing device and on the connections thereof with the hinged member and with the support.

In the Samson gate closer, the pushrod has a toothed rack which co-operates with a pinion provided on the rotary damper shaft. The hydraulic damper mechanism comprises a screw-threaded piston/piston rod motion converting mechanism in which the damper shaft is screwed into the piston so that the rotational motion of the pinion is converted into a translational motion of the piston. When the pushrod is pushed in maximally, i.e. over a distance of 140 mm, the piston moves over a distance of about 47 mm and displaces about 112 ml of hydraulic liquid since the piston has a diameter of 55 mm. When the door or gate is being closed, part of this hydraulic liquid flows through the clearance between the piston and the cylinder whilst another part of the hydraulic liquid flows through a restricted fluid passage which is provided with an adjustable needle valve. In the example described in WO 2011/023793, the diameter of the cylinder is, at 20° C., 0.03 mm larger than the diameter of the piston so that, at this temperature, the clearance between the piston and the cylinder has a surface area of 2.6 $mm^2$. By the use of a synthetic material for the piston, which has a larger thermal expansion coefficient than the aluminium of the cylinder, the surface area of the clearance between the piston and the cylinder becomes smaller as the temperature increases and becomes larger as the temperature decreases thus compensating for the change of the viscosity of the hydraulic liquid as a result of a change of the temperature.

A drawback of this prior art closing device is that the piston of the hydraulic damper mechanism moves up and down in the cylinder barrel so that this cylinder barrel has to project over a relatively large distance underneath the actuator mechanism. The lead of the screw thread on the damper shaft, which has four starts, has moreover to be quite large, and is equal to about 30 mm, so that due to the play between the co-operating threads, which has also to be relatively large to reduce the friction, the closing movement of the closure member is not immediately damped. When releasing the closure member, it is therefore closed initially at a higher speed until the screw thread on the damper shaft suddenly engages the screw thread on the piston again so that the closing movement is suddenly slowed down and the piston starts to be moved in the opposite direction to damp the closing movement. The transition between the opening and the closing movement is thus not smooth as the initially undamped movement is suddenly damped when the screw thread on the damper shaft engages the screw thread on the piston. A final important drawback is that, notwithstanding the relatively large play between the screw thread on the damper shaft and the screw thread on the piston, quite a lot of energy is lost by frictional forces between the screw threads on the piston and on the damper shaft. The spring constant of the compression spring has thus to be higher so that larger forces need to be exerted onto the closure member to open it and larger stresses arise in the closing device.

Other prior art closing devices with a hydraulic damper and with a pushrod comprise a horizontal hydraulic cylinder wherein the pushrod is formed by the piston rod which slides in and out of the hydraulic cylinder. Such a closing device is for example disclosed in U.S. Pat. No. 3,057,004. A drawback of these closing devices is that hydraulic liquid is lost through the sliding seal between the piston rod and the cylinder barrel. Although this loss may be quite limited, the closing device is not maintenance free which is an important disadvantage. Moreover, a tight sliding seal causes additional frictional losses. The piston itself is also provided with an elastic seal, which increases the frictional forces between the piston and the cylinder.

To avoid oil losses, U.S. Pat. No. 3,028,620 discloses a hydraulic damper which comprises two horizontal cylinders, one on top of the other. The uppermost cylinder receives the pushrod whilst the lowermost cylinder houses the piston and the piston rod. The pushrod is connected to the piston rod through a slit connecting the upper to the lower cylinder cavity. Only the lower cylinder cavity is filled with hydraulic liquid. A drawback of such a hydraulic damper is that a long hydraulic cylinder has to be provided since not only the piston but also the piston rod has to reciprocate within the hydraulic cylinder. The closing device is therefore also quite voluminous. Moreover, an elastic seal is provided between the piston and the cylinder wall which increases the frictional forces between the piston and the cylinder. Due to the presence of this elastic seal, a compensation of a varying viscosity of the hydraulic liquid by the use of a piston with a higher thermal expansion coefficient than the cylinder, as disclosed in WO 2011/023793, can therefore not be applied. Even without an elastic seal around the piston, this would still not be possible since the diameter of the piston is too small to achieve a sufficiently large change of the width of the clearance between the piston and the cylinder wall upon a change of the temperature to be able to compensate for the change in viscosity of the hydraulic liquid. Providing a clearance which is considerably smaller than the clearances disclosed in WO 2011/023793 in order to increase the relative effect of the temperature on the width of this clearance is not feasible is practice, especially not for long cylinder cavities such as in the hydraulic dampers disclosed in U.S. Pat. No. 3,057,004 and U.S. Pat. No. 3,028,620. Moreover, when providing only a very small clearance between the piston and the cylinder wall, only a very small part of the hydraulic liquid would be able to flow through such a clearance so that any change thereof would almost not affect the total flow of liquid. Nearly all of the hydraulic liquid would indeed flow through the restricted passage instead of through the clearance between the piston and the cylinder wall.

Another type of hydraulically damped door closers comprises the door closers which don't have a pushrod but which have instead a rotating arm. The rotating arm is mounted on a vertical shaft which carries a pinion. A rack on the piston rod co-operates with this pinion so that the piston reciprocates in the cylinder cavity. The door closer is mounted with the hydraulic cylinder in a horizontal position. An example of such a door closer is disclosed in EP 1 959 081. A drawback of such door closers is that either the horizontal hydraulic cylinder or the rotating arm is to be mounted above the door onto the door frame. Such door closers thus require a door frame above the door and can therefore not be used for doors or gates which have no frame on top of the door or gate. Generally, this is the case for outdoor applications, for example for garden gates. When applying such a door closer for garden gates without a frame, a projecting arm has to be mounted on the front side of the support so that the door closer can be mounted between this arm and the hinged member. A drawback thereof is that this projecting arm can be dangerous for a person approaching the gate whilst also the rotating arm can be dangerous since it forms a scissor mechanism that can cut or trap fingers, especially when it is situated on a relatively low level which is often the case with garden gates.

Another type of gate closer which comprises a rotating arm and which is offered for sale by the applicant under the name Verticlose is disclosed in WO 2011/023793. Just like the Samson gate closer disclosed in this international patent publication, the damper shaft is screwed into the piston so that the rotational motion of this damper shaft is converted into a translational motion of the piston. In this way, the hydraulic cylinder can be mounted vertically instead of horizontally. The rotary gate closer shows however the same disadvantages as to friction and lack of a smooth operation as described hereabove for the Samson gate closer comprising the same screw-threaded piston/piston rod motion converting mechanism. Moreover, a torsion spring has to be used which increases the height of the closing device even more and which is less appropriate for closing larger or heavier gates.

An object of the present invention is now to provide a new closing device which has a hydraulic damper mechanism and an actuator mechanism with a pushrod and a resilient member but which does not show the above-described disadvantages of a damper with a screw-threaded piston/piston rod motion converting mechanism and which does not show the friction losses caused by the presence of an elastic seal on the piston and the oil leakage which always occurs when use is made of a piston rod which slides horizontally in and out of the hydraulic cylinder.

SUMMARY OF THE INVENTION

To this end, the closing device according to the present invention is characterised in that the hydraulic damper mechanism comprises a piston rod fixed to the piston to reciprocate together with the piston in the cylinder cavity; in that the second motion converting mechanism comprises a second rack and pinion gearing arranged within the cylinder cavity and having a second rack formed by the piston rod and a second pinion engaging the second rack; and in that said transmission provides together with said first and second pinions a reduction gearing between the pushrod and the piston so that said piston reciprocates over a smaller distance than said pushrod.

Since the rotational movement of the pinion that co-operates with the rack on the pushrod is converted by the second rack and pinion gearing in a reciprocating motion of the piston, the frictional forces are smaller than for a screw-threaded piston/piston rod motion converting mechanism and the closing movement of the closure member can almost immediately be damped when the closure member is released due to the limited play between the teeth on the racks and the pinions. Moreover, the hydraulic cylinder can be mounted horizontally between the closure member and the support thereof so that the closing device can be more compact. The smaller stroke of the piston provided by the presence of the reduction gearing enables to reduce also the length of the cylinder cavity, even when the piston rod is also contained completely in the cylinder cavity to avoid oil leakage.

A further important advantage of a smaller stroke of the piston is that the cylinder cavity can be made accurately, for example by a cutting technique, so that a clearance fit can be provided between the piston and the cylinder wall. In this way, hydraulic liquid can flow along the piston and the friction between the piston and the cylinder wall is reduced, in particular compared to a press fit wherein an elastic seal is provided between the piston and the cylinder wall.

Another important advantage is that the diameter of the piston can be increased while keeping the ratio between the amount of hydraulic liquid displaced for a maximum stroke of the piston and the diameter of the piston below a maximum value. Preferably, this ratio is smaller than 3.0 ml/mm, more preferably smaller than 2.5 ml/mm so that the amount of displaced hydraulic liquid is relatively small compared to the circumference of the piston. This is important to be able to compensate for a varying viscosity of the hydraulic liquid as a result of a change in temperature. Indeed, the clearance, at 20° C., between the piston and the cylinder wall may be relatively small whilst still enabling a considerable portion of the hydraulic liquid to flow along the piston instead of through any additional adjustable restricted fluid passage. By making the clearance between the piston and the cylinder wall smaller, a higher thermal expansion coefficient of the piston has a larger effect on the surface area of this clearance, and thus on the amount of hydraulic liquid flowing along the piston, and since the amount of hydraulic liquid flowing along the piston is relatively large (at 20° C.) compared to the total amount of hydraulic liquid displaced by the piston, the varying surface area of the clearance has a sufficiently large effect on the damping forces to be able to compensate for a varying viscosity of the hydraulic liquid. The closing device according to the present invention enables thus the use of a relatively large piston which provides a sufficiently large increase or decrease of the clearance between the piston and the cylinder wall as a function of the temperature whilst keeping the amount of hydraulic liquid displaced for one stroke of the piston sufficiently small so that the varying surface area of the clearance between the piston and the cylinder wall can compensate for a varying viscosity of the hydraulic liquid.

In a preferred embodiment of the closing device according to the present invention, said piston has, at least at 20° C., a diameter which is smaller than the diameter of said cylinder cavity at the location of the piston so that a clearance is present between the piston and an inner surface of the cylinder barrel, said at least one restricted fluid passage comprising said clearance.

Preferably, said cylinder barrel is made of at least a first material and the piston of at least one second material which is selected to have such a thermal expansion coefficient, different from the thermal expansion coefficient of said first material, that the surface area of said clearance decreases when the temperature of the damper mechanism increases from 20° C. to 30° C. and increases when the temperature of the damper mechanism decreases from 20° C. to 10° C.

The piston has preferably a diameter which is larger than 20 mm, preferably larger than 25 mm and more preferably larger than 30 mm.

In a preferred embodiment of the closing device of the present invention, said reciprocating pushrod is slidably mounted on said frame between two extreme positions determining a maximum stroke of the pushrod and said reduction gearing has such a gear ratio that when the pushrod is moved over its maximum stroke the amount of hydraulic liquid displaced by the piston is comprised between 1.0×D ml and 3.0×D ml, which amount is preferably larger than 1.5×D ml and preferably smaller than 2.5×D ml, with D being the diameter of the piston in mm.

These amounts of displaced hydraulic liquid and the minimum diameters of the piston enable an effective compensation of the effect of the temperature on the viscosity of the hydraulic liquid.

In an advantageous embodiment of the closing device according to the present invention, that said first motion converting mechanism is arranged outside the closed cylinder cavity and said transmission preferably comprises a rotary shaft which enters said closed cylinder cavity in said first side thereof.

A rotary shaft can be sealed more easily against oil leakage than a sliding rod. Moreover, the rotary shaft preferably enters the closed cylinder cavity through an upper side of the cylinder barrel so that no hydraulic liquid can flow along the rotary shaft out of the cylinder cavity. The rotary shaft enters the closed cylinder cavity preferably in the first side thereof, i.e. in the side of the cylinder cavity which is not pressurized when the closure member is being closed by the closing device, so that in this way no pressurized hydraulic liquid comes in contact with the seal around the rotary shaft.

BRIEF DESCRIPTION OF THE DRAWINGS

Other particularities and advantages of the invention will become apparent from the following description of some particular embodiments of the closing device according to the present invention. The reference numerals used in this description relate to the annexed drawings wherein.

DETAILED DESCRIPTION OF THE INVENTION

Figure 1:
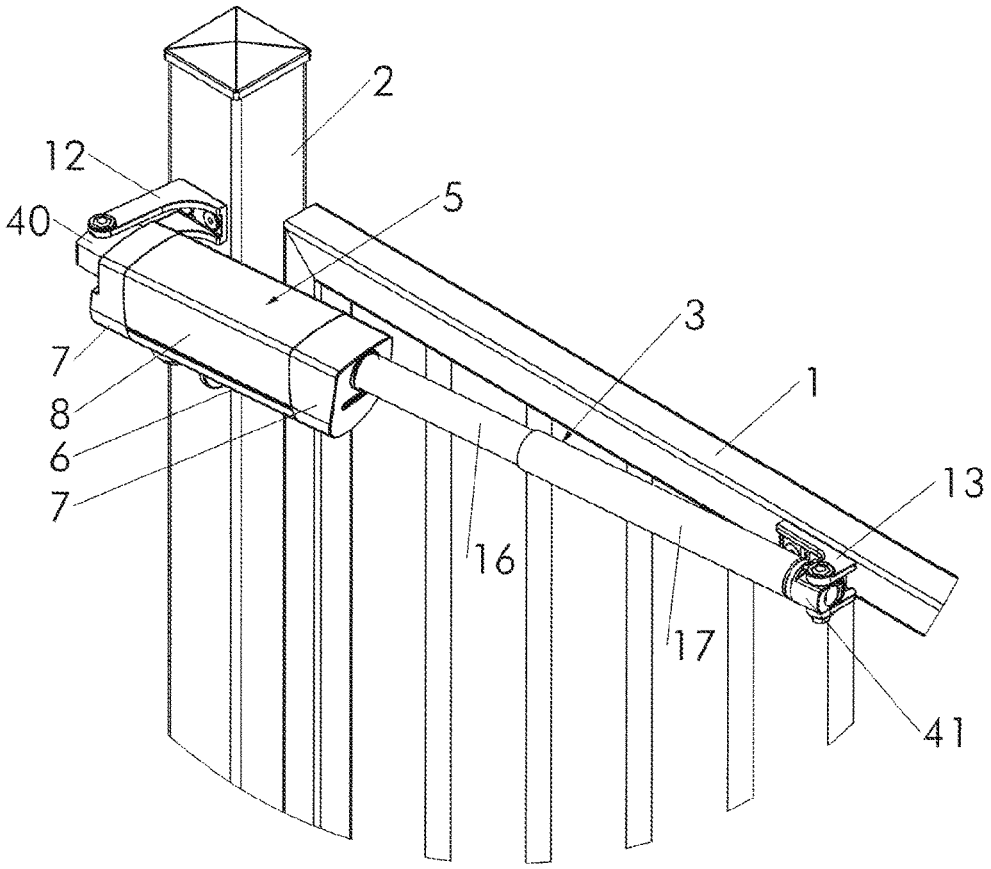
FIG. 1 is a perspective view on an embodiment of the closing device according to the present invention mounted on a garden gate which is suspended by means of so-called 180° hinges on a fixed post.

The closing device of the present invention is a device for closing a closure member 1 hinged on a support 2. The closure member 1 can be a door, surrounded by a door frame acting as support for the door, but the closure member 1 of the present invention is especially intended for gates. Gates are normally not surrounded by a frame in contrast to a door which is surrounded by a door frame which also extends above the door. The support 2 of a gate may for example be a post fixed onto or into the ground or a wall or another part of a fence. The closing device is an elongated device having one of its two extremities hingedly mounted, by means of a first bracket 12, onto the support 2, more particularly on the front side thereof, and having its other extremity hingedly mounted, by means of a second bracket 13, onto the hinged closure member 1. Both extremities of the closing device are respectively provided with a first hinge part 40, which is arranged to co-operate with the first bracket 12, and with a second hinge part 41, which is arranged to co-operate with the second bracket 13. The axis of the hinges 11 of the closure member and the hinge axis of the closing device on the support do not coincide so that the closing device is compressed when the closure member is opened and is extended when the closure member is closed.

The closing device comprises an actuator mechanism 3, which has a resilient member 4 arranged to urge the hinged closure member 1 towards its closed position, and a hydraulic damper mechanism 5 for damping the closing movement of the hinged closure member 1 under the action of the resilient member 4. The closing device 3 preferably comprises a main body 6 which is made in one piece of an extruded aluminium profile and which is provided with two end caps 7 covering the two extremities of the aluminium body 6 and with a cover 8.

The use of an extruded aluminium profile has several advantages compared to a main body which is die cast from an aluminium alloy. First of all extruded aluminium can be anodized to protect it against corrosion, in contrast to die cast aluminium. Moreover, die cast aluminium comprises air inclusions so that it is porous as a result of which hydraulic liquid may leak out of the hydraulic cylinder. In practice, it has been found that up to 50% of die cast hydraulic cylinders have to be discarded because they are not sufficiently impervious. To avoid such air inclusions vacuum die cast installations can be used but they are much more expensive thus increasing the manufacturing costs. Compared to die cast aluminium, extruded aluminium is moreover less brittle and hence less prone to breaking, especially at the location where the telescopic arm is mounted onto the aluminium body, for example when somebody would step on this telescopic arm. As explained hereinafter, the main body forms both a part of the actuator mechanism 3 and of the damper mechanism 5 so that both mechanisms are strongly and reliably connected to one another by the single piece of extruded aluminium profile.

Figure 11:
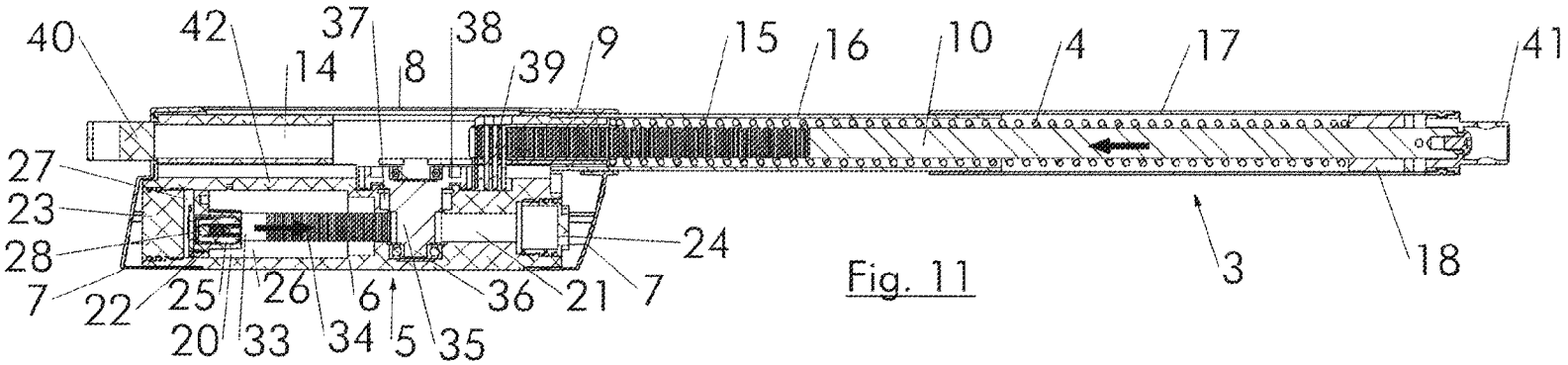
FIG. 11 is a longitudinal sectional view in elevation through the middle of the closing device, indicated by arrows XI-XI in FIG. 12.
Figure 12:
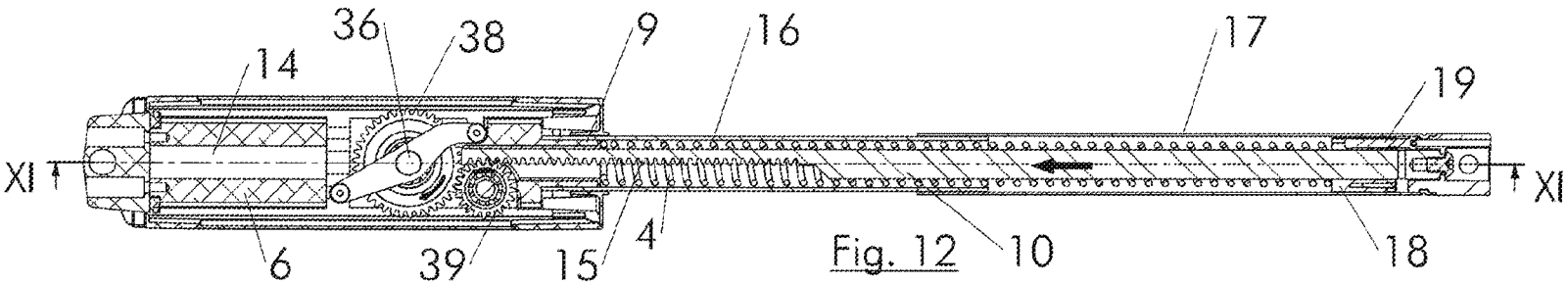
FIGS. 12 and 13 are longitudinal sectional views indicated by arrows XII-XII and XIII-XIII in FIG. 10.
Figure 13:
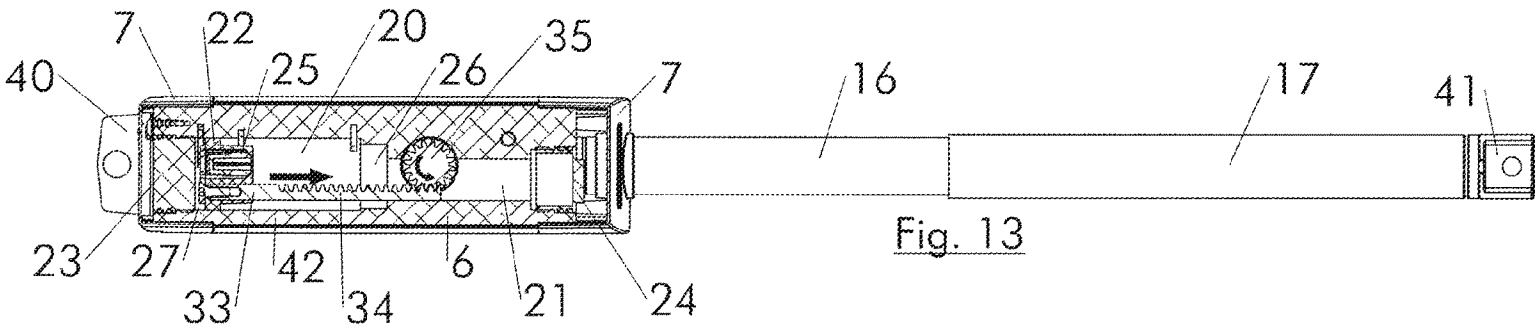
Figure 14:
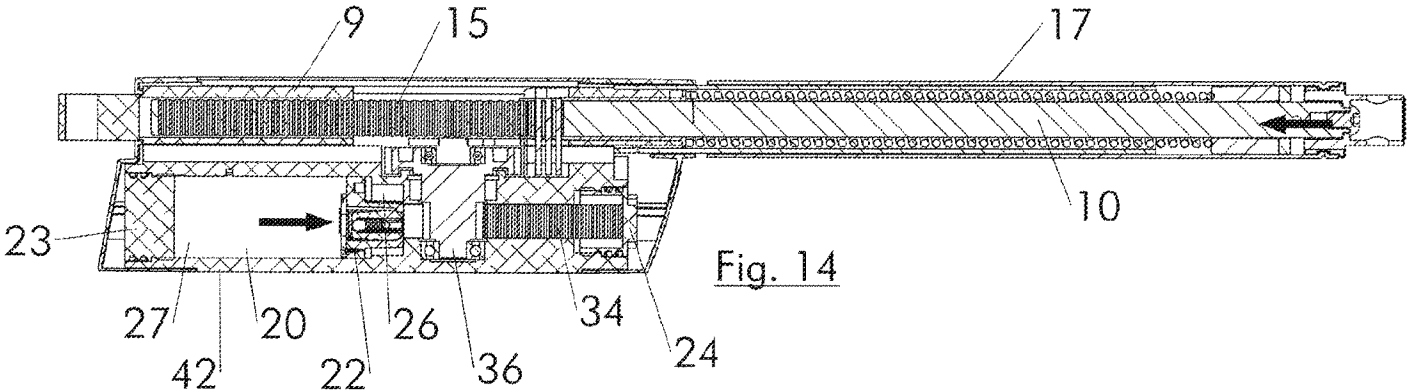
FIGS. 14 to 16 are the same views as FIGS. 11 to 13 but show the closing device in its compressed instead of its extended position, i.e. with the garden gate onto which it is mounted in its open instead of in its closed position.
Figure 15:
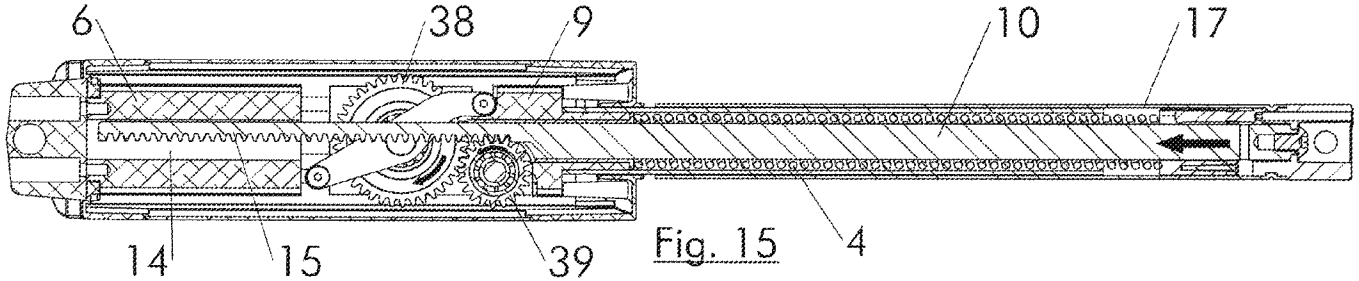
Figure 16:
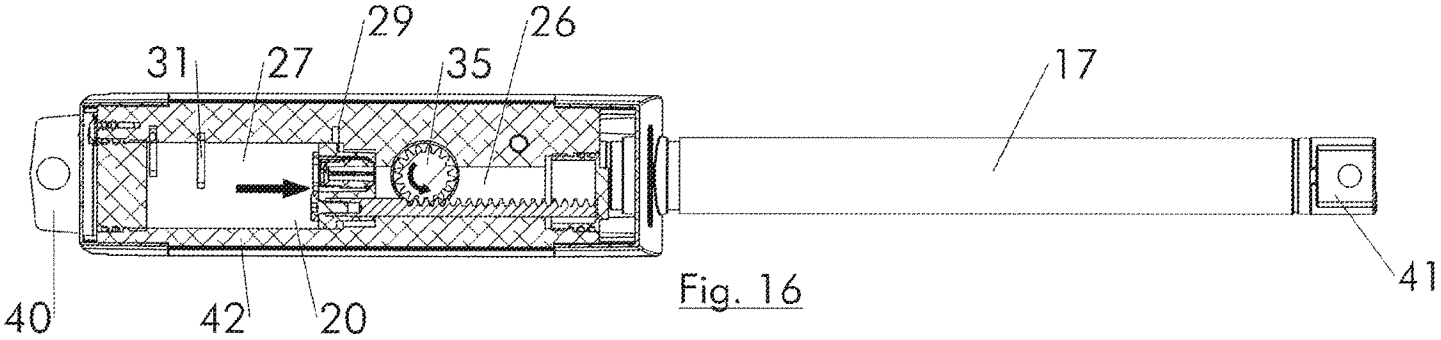

The actuator mechanism 3 of the closing device illustrated in the figures is a telescopic mechanism which comprises, as can be seen for example in FIG. 11, a frame 9, a reciprocating pushrod 10 which is slidably mounted on this frame 9 and the resilient member 4 arranged between the pushrod 10 and the frame 9. The reciprocating pushrod 10 can translate between two extreme positions, namely between the maximally extended position, illustrated in FIGS. 11 to 13 and the maximally retracted position, illustrated in FIGS. 14 to 16. The pushrod 10 moves between an extended and a retracted position when opening and closing the hinged closure member 1. These two positions correspond either to the two extreme positions of the pushrod 10 or are situated between these two extreme positions so that the maximum stroke of the piston rod 10 is not always used. The distance between the extended and the retracted position of the pushrod 10 depends on the relative positions wherein the closing device and the closure member 1 are hingedly mounted on the support 2.

Figure 2:
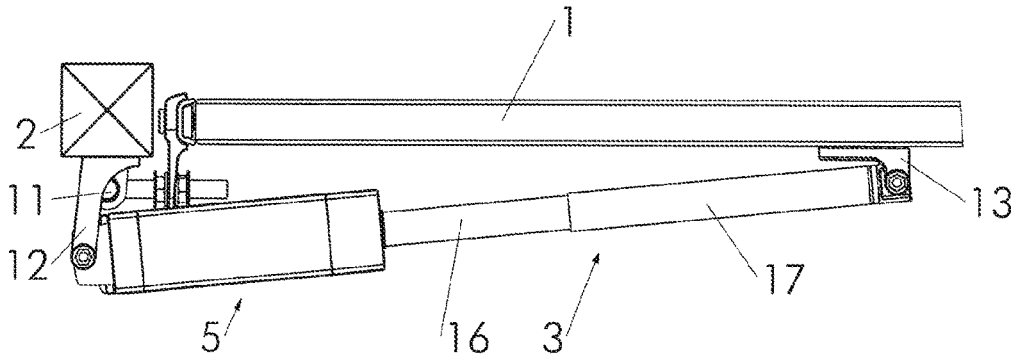
FIG. 2 is a top plan view on the closing device and the garden gate illustrated in FIG. 1.
Figure 3:
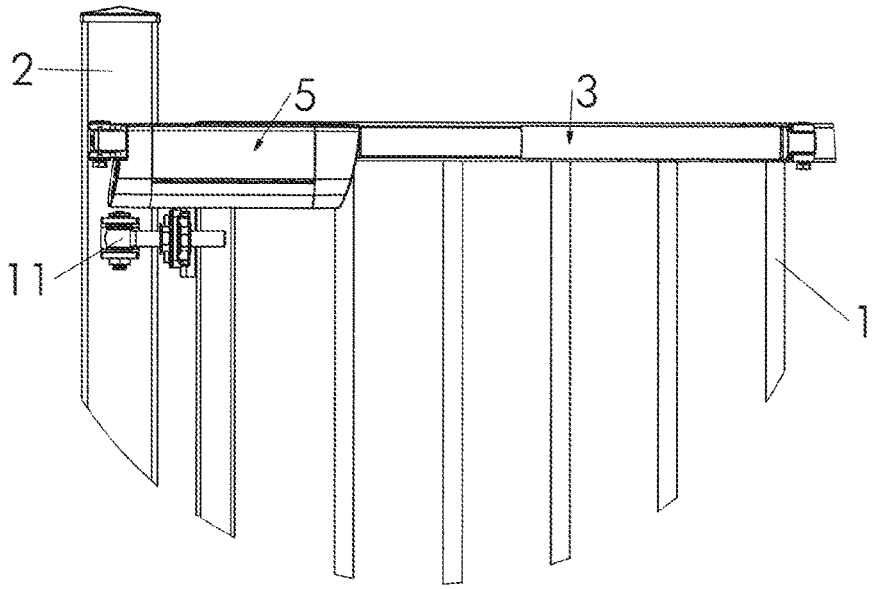
FIG. 3 is a front elevation view on the closing device and the garden gate illustrated in FIG. 1.
Figure 4:
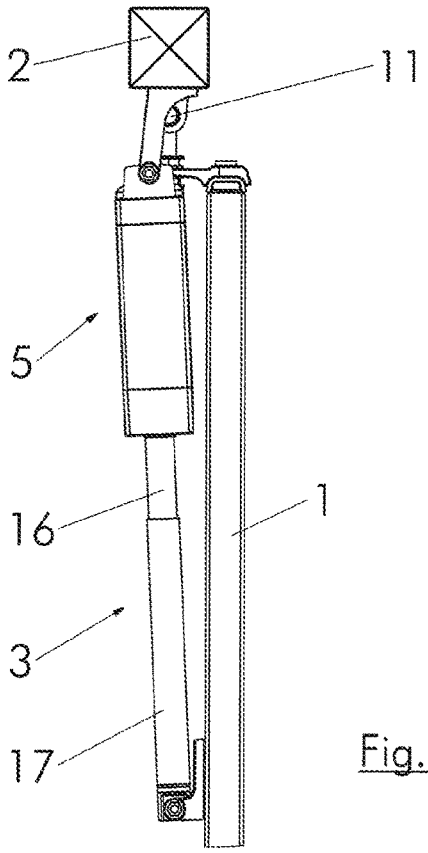
FIG. 4 is a same view as FIG. 2 but with the gate in the open instead of in the closed position.
Figure 5:
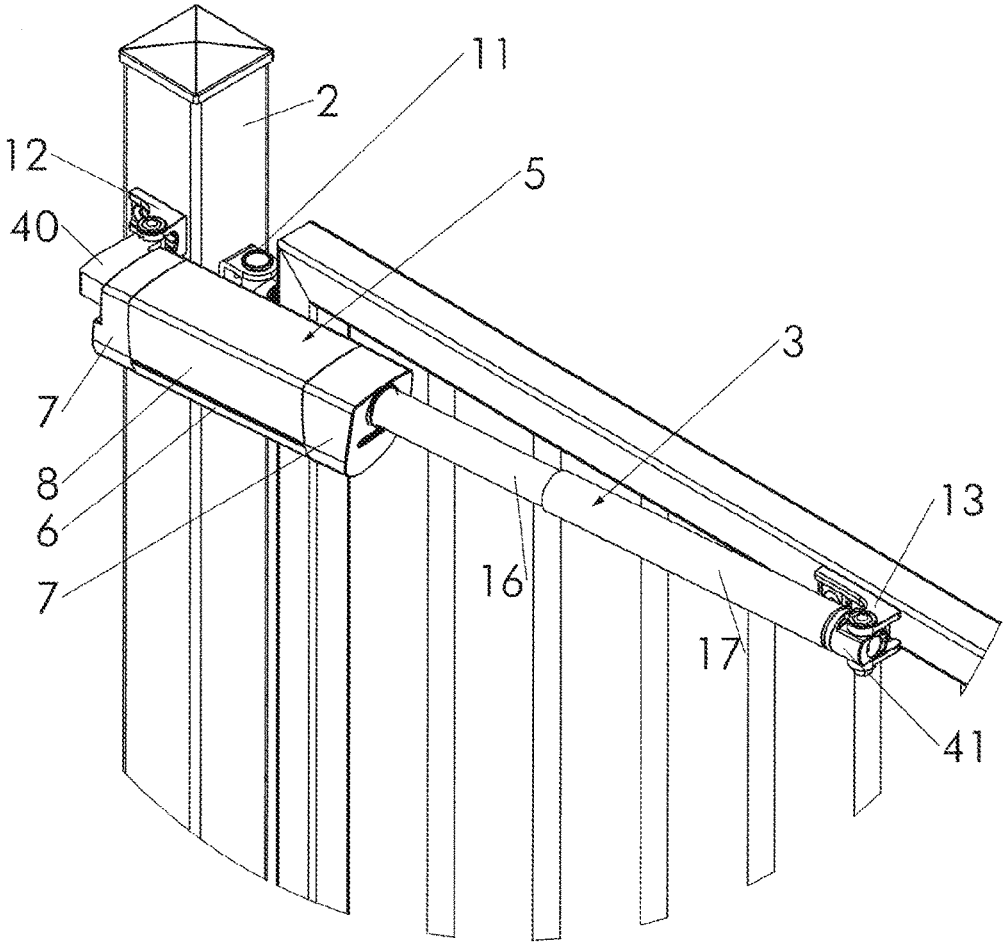
FIGS. 5 to 8 are the same views as FIGS. 1 to 4 but show the closing device mounted on a garden gate suspended by means of so-called 90° hinges on the fixed post.
Figure 6:
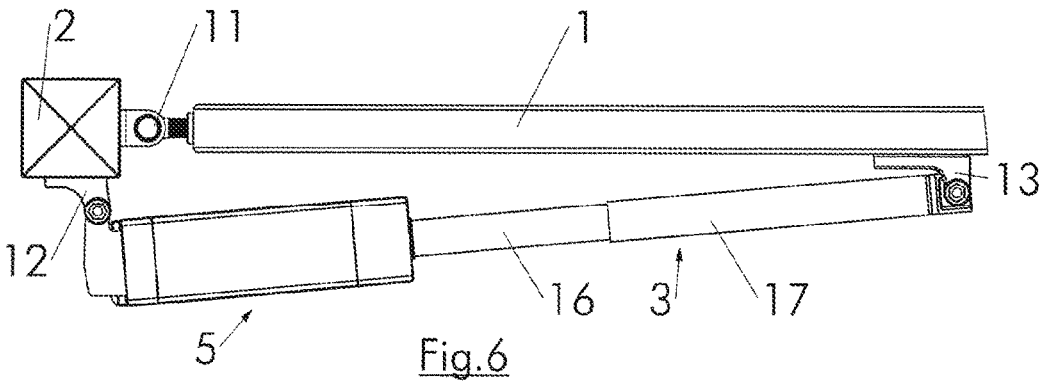
Figure 7:
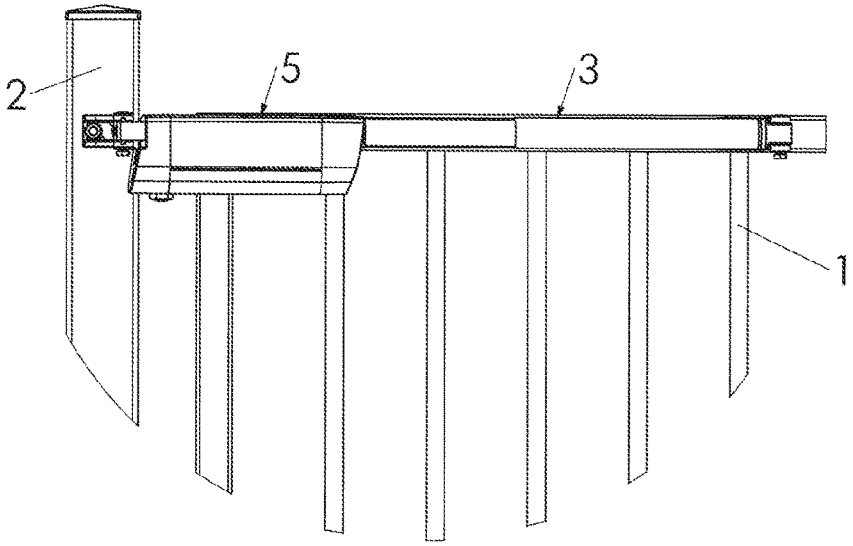
Figure 8:
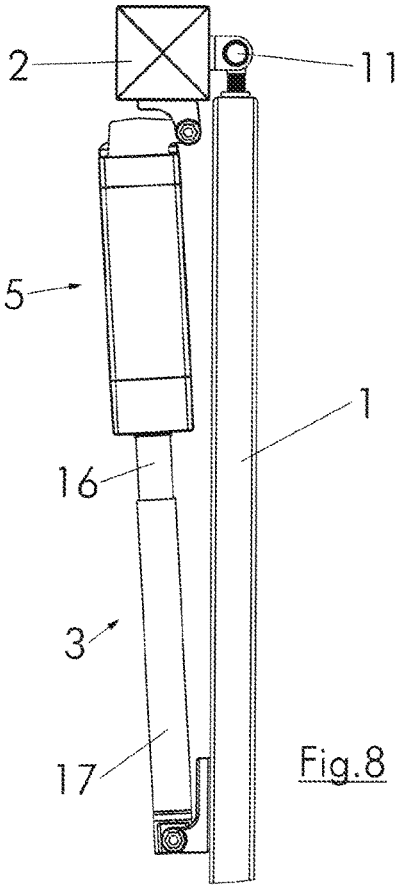

The maximum stroke of the pushrod 10 is preferably larger that 100 mm, more preferably larger than 120 mm and most preferably larger than 140 mm, for example 160 mm. Due to such a large maximum stroke, the positions wherein the closing device is mounted on the hinged closure member 1 and on the support 2 thereof (which may depend for example on the diameter or thickness of the support) has a smaller effect on the functioning of the closing device. Moreover, different types of hinges 11 can be used, for example so-called 180° hinges, illustrated in FIGS. 1 to 4, and so-called 90° hinges, illustrated in FIGS. 5 to 8. As can be seen in FIG. 2, a 180° hinge is mounted on the front side of the support 2 whilst, as can be seen in FIG. 6 a 90° hinge is mounted on the lateral side of the support 2 facing the hinged closure member 1 in its closed position. Since the closing device is hingedly mounted also on the front side of the support 2, the bracket 12 used for hingedly mounting the closing device on the support 2 is longer for a 180° hinge than for a 90° hinge. The closing device is thus very versatile and provides a certain freedom as to the exact mutual mounting position of the closing device 1 on the support 2 with respect to the hinge axis of the hinged closure member 1.

The resilient member 4 of the actuator mechanism 3 illustrated in the drawings is a helical compression spring. Alternatively, a pneumatic spring (i.e. an air spring) could be used or also a tension spring or even a torsion spring but a compression spring enables the most compact and reliable mechanism. A compression spring is also the most compact solution for enabling a large stroke of the pushrod 10. An advantage of a larger stroke is that more energy can be stored in the resilient element without having to increase the spring constant, i.e. a weaker spring can be used which generates less stresses in the device and on the hinges or the brackets 12, 13 by means of which the closing device is hingedly mounted onto the support 2 and on the hinged closure member 1.

The frame 9 of the actuator mechanism 3 comprises first of all a portion of the aluminium body 6 of the closing device. This portion comprises a longitudinal circular hole 14, which is extruded and which is arranged to slidably receive the pushrod 10. The pushrod 10 has a circular cross-section which fits in this longitudinal hole 14 and part of which has been cut away to form a toothed rack 15. The frame 9 of the actuator mechanism 3 further comprises a tube 16, which is preferably made of stainless steel, and which is mounted, in particular flanged, around the portion onto the aluminium body 6 which forms the longitudinal hole 14 to extend the longitudinal hole 14 wherein the pushrod 10 slides. The distal extremity of the pushrod 10 is provided with a cap 18 onto which a larger tube 17, which slides telescopically over the projecting part of the tube 16, is mounted. The tube 16 has a larger inner diameter than the longitudinal hole so that the helical compression spring 4 can be applied in the tubes 16 and 17 around the pushrod 10. The compression spring 4 is compressed between the aluminium body 6 and the cap 18 on the distal extremity of the pushrod 10 to urge the pushrod towards its extended position. The force exerted by the spring 4 can be adjusted by means of a set screw 19, shown in FIG. 12, which enables to change the position of the cap 18 on the pushrod 10.

Figure 17:
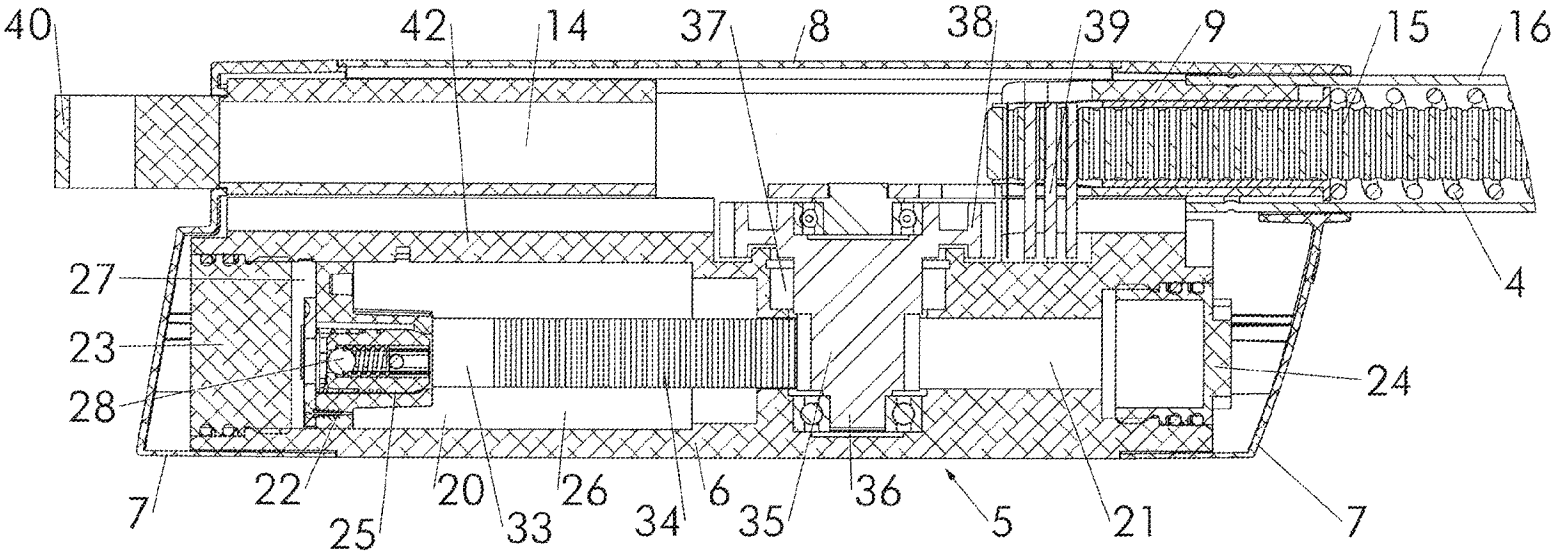
FIG. 17 is a same view as FIG. 11 but on a larger scale and showing only the hydraulic damper mechanism with a part of the actuator mechanism.
Figure 20:
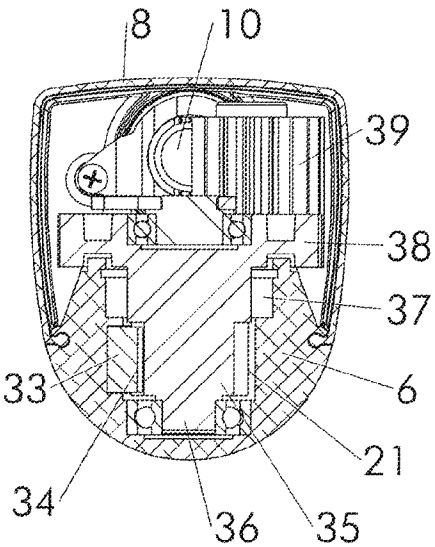
FIGS. 18 to 20 are also on a larger scale cross-sectional views indicated by arrows XVIII-XVIII, XIX-XIX and XX-XX in FIG. 10.
Figure 19:
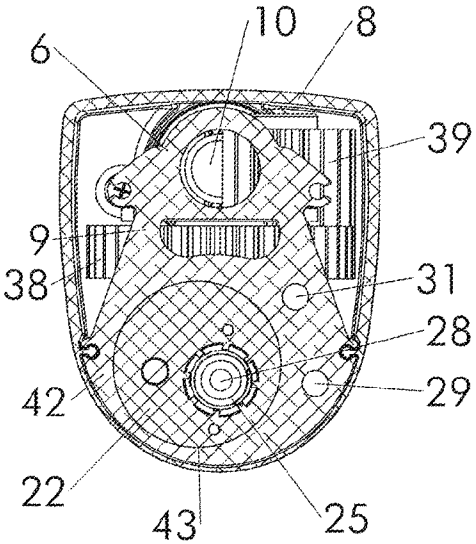
Figure 18:
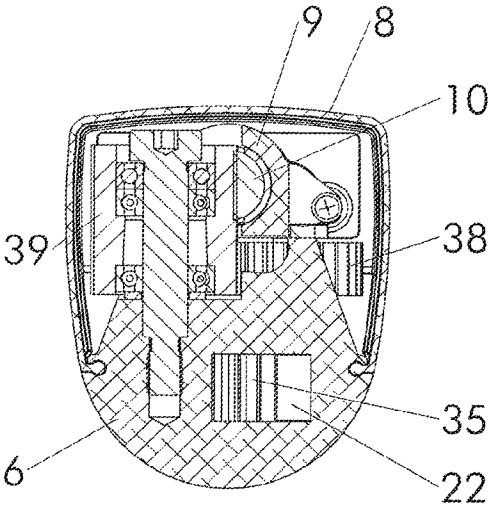

The hydraulic damper mechanism 5, illustrated on a larger scale in FIG. 17, comprises a cylinder barrel 42 which defines a closed cylinder cavity 20. The cylinder barrel 42 is formed by the aluminium body 6 which has a longitudinal, rectangular extruded hole 21. This hole is enlarged on one side by a cutting process to make the cylinder wherein the piston 22 reciprocates. This enlarged hole is closed off by means of an oil plug 23 provided with seal rings. The other end of the rectangular hole 21 is also cut to obtain an enlarged cylindrical hole and is screw threaded to be closed of by means of an oil plug 24 which is also provided with seal rings. In contrast to rotating seals, such static seals enable a perfect sealing of the cylinder cavity 20.

The piston is provided with a one-way valve 25 which allows flow of hydraulic liquid from a first side 26 to a second side 27 of the cylinder cavity 20 when the hinged closure member 1 is opened. Within this one-way valve 25 is a safety valve 28 which enables flow of hydraulic liquid from the second side 27 of the cylinder cavity 20 to the first side 26 thereof when the pressure in the second side 27 of the cylinder cavity 20 exceeds a predetermined threshold level, in particular when an excessive force is exerted onto the hinged closure member 1 to close it. This additional force can be exerted thereon by a person or by the wind. The safety valve 28 protects the closing device in such a case from getting damaged.

Figure 9:
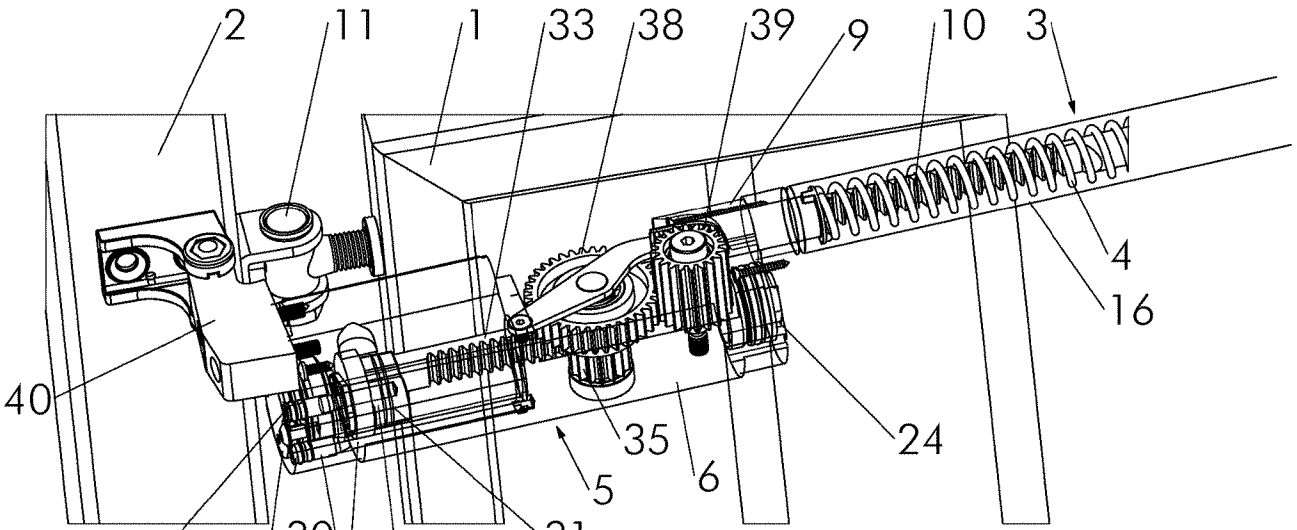
FIG. 9 is an enlarged view on the closing device mounted on the garden gate as illustrated in FIGS. 5 to 7 wherein the lid and the housing of the closing device are shown in a transparent way to show the internal parts of the closing device.
Figure 10:
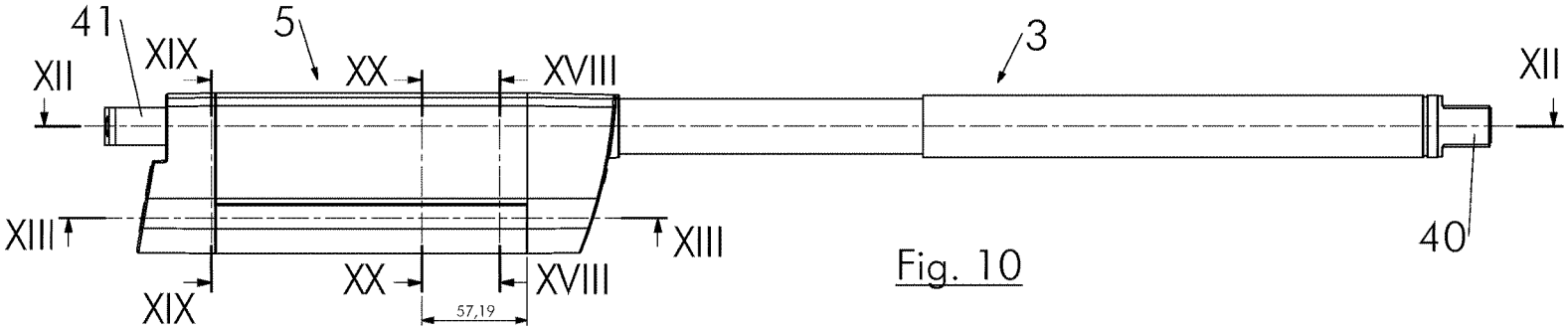
FIG. 10 shows a front elevation view on the closing device itself.

After having opened the hinged closure member 1, it is automatically closed again by the action of the compression spring 4 urging the pushrod 10 to its extended position and hence the closure member 1 to its closed position. The closing movement is damped by the piston 22 moving towards the second side 27 of the cylinder cavity 20. To enable flow of hydraulic liquid from the second side 27 to the first side 26 of the cylinder cavity 20, at least one restricted fluid passage is provided between these two sides of the cylinder cavity. One restricted fluid passage being formed by a channel 29 (see FIG. 9) connecting in all the possible positions of the piston 22, i.e. in all the positions between its two extreme positions, the first side 26 of the cylinder cavity 20 with the second side 27 thereof. This channel 29 is provided with an adjustable valve 30, in particular a needle valve, so that the flow of hydraulic liquid through this channel 29 can be controlled, in particular depending on the mounting position of the closing device, i.e. depending on the distance over which the pushrod is moved when opening and closing the hinged closure member 1.

A further restricted fluid passage is provided by making the diameter D of the piston 22, at least at 20° C., somewhat smaller than the diameter of the cylinder cavity 20. This further restricted fluid passage is thus formed by the clearance 43 between the piston 22 and the inner surface of the cylinder barrel 42. The closing movement of the closure member 1 is thus damped due to the fact that the hydraulic liquid can only flow through the two restricted fluid passages.

In the embodiment illustrated in the figures, a further restricted fluid passage 31 is provided to allow flow of hydraulic liquid from the second side 27 of the cylinder cavity 20 to the first side 26 thereof when the closure member 1 is nearly closed. This further restricted fluid passage 31 forms a by-pass which causes an increase of the closing speed at the end of the closing movement to ensure that the closure member 1 is reliably closed. The flow of hydraulic liquid through this further restricted fluid passage 31 is adjustable by means of a further adjustable valve 32.

To couple the piston 22 to the pushrod 10 so that both move together, the piston 22 is first of all provided with a piston rod 33. This piston rod 33 is fixed to the piston 22 and reciprocates together with the piston 22 in the cylinder cavity 20. The piston rod 33 has a rectangular cross-section and moves with its distal extremity in the rectangular hole 21 in the aluminium body 6. In this way, it is well supported by one side of the rectangular hole 21.

The piston rod 33 forms a toothed rack 34 which cooperates with a pinion 35 on a rotary shaft 36 which enters the cylinder cavity 20 in the first side 26 thereof. The rotary shaft 36 is provided with a seal 37. Since the rotary shaft 36 enters the cylinder cavity 20 through the top thereof and since it enters the cylinder cavity 20 in the first side 26 thereof, i.e. in the side where the hydraulic liquid is not pressurized when the closing movement is damped, no hydraulic liquid can escape through this rotating seal.

Outside the cylinder cavity 20, the rotary shaft 36 is provided with a gear 38 which engages a pinion 39 which in its turn engages the toothed rack 15 on the pushrod 10. The gear 38 has a larger pitch diameter than the pinion 35 on the rotary shaft 36 so that the pinions 35 and 39 and the gear 38 form a reduction gearing between the pushrod 10 and the piston 22. In this way the piston 22 reciprocates over a smaller distance than the pushrod 10. In an alternative embodiment, the gear 38 could engage the rack 15 on the pushrod 10 directly so that the gear 38 forms the pinion engaging the rack 15 on the pushrod 10. The use of an intermediate pinion 39 enables however to arrange the pushrod 10 in the middle of the closing device so that it can be used for a left and a right turning closure member 1 without any effect on the functioning of the closing device. Optionally, a gearing comprising one or more additional pinions can be provided between the pinion 39 and the gear 38.

The pinion 39 and the toothed rack 15 on the pushrod 10 forms a first motion converting mechanism converting the translational movement of the pushrod 10 into a rotational motion of the first pinion 39. This first motion converting mechanism is arranged outside the cylinder cavity 20. The second pinion 35 and the rack 34 on the piston rod 33 forms a second motion converting mechanism which is part of a transmission which transmits and converts the rotational motion of the first pinion 39 into a translational motion of the piston 22.

Especially when the closing device is for outdoor use, it preferably comprises a system which provides for a compensation of the effect of a variation of the viscosity of the hydraulic liquid, as a result of a change of the temperature, on the damping effect of the hydraulic damping mechanism. Such a temperature compensation effect can be achieved by making the cylinder barrel 42 of at least one first material and the piston 22 of at least one second material which is selected to have such a thermal expansion coefficient, different from the thermal expansion coefficient of said first material, that the surface area of the clearance 43 between the piston 22 and the wall of the cylinder cavity 20 decreases when the temperature of the damper increases from 20° C. to 30° C. and increases when the temperature of the damper decreases from 20° C. to 10° C.

In the embodiment described hereabove, the cylinder barrel 42 is made of extruded aluminium whilst the piston is made of a synthetic material. The piston 22 can be made, by injection-moulding, of polyoxymethylene (POM) which is sold for example under the brand Hostaform® C9021. Since the thermal expansion coefficient can depend on the geometry of the parts and on the composition thereof in case it is made of different materials, the real thermal expansion coefficient is preferably measured after having manufactured the cylinder and the piston, more particularly by measuring the diameters thereof for example at −25° C. and at 20° C. These measurements gave a thermal expansion coefficient for the cylinder of $3.23\times10^{-5}$ $K^{-1}$ and for the piston of $6.215\times10^{-5}$ $K^{-1}$.

The difference between the inner diameter of the cylinder and the outer diameter of the piston 22 comprises for example 0.04 mm at 20° C. Although the cylinder cavity can be cut quite accurately in the aluminium body, this will always be with some tolerances in practice. The difference in diameter of 0.04 mm is therefore the nominal difference whilst the actual difference can vary for example between a minimum of 0.02 mm and a maximum of 0.08 mm. Depending on the tolerances of the cutting process, the nominal difference between the two diameters should therefore be large enough, in particular larger than 0.02 mm, preferably larger than 0.03 mm at 20° C. On the other hand, the difference between the two diameters should preferably not be too large so that the variation of this difference upon a change of the temperature is sufficiently large compared to the actual difference between the two diameters. The nominal difference between the two diameters, at 20° C., is therefore preferably smaller than 0.1 mm, more preferably smaller than 0.8 mm and most preferably smaller than 0.6 mm.

The larger the diameter of the piston, the larger the effect of the temperature on the width of the clearance 43 between the piston 22 and the wall of the cylinder cavity 20. The diameter of the piston 22 is therefore preferably larger than 20 mm, more preferably larger than 25 mm and most preferably larger than 30 mm. The diameter of the piston is for example equal to 38 mm. In order to remain compact, this diameter is preferably smaller than 70 mm, more preferably smaller than 60 mm and more preferably smaller than 50 mm.

Depending on the diameter of the piston 22, the amount of hydraulic liquid that is displaced when the piston 22 is moved from one of its two extreme positions to the other one is preferably within predetermined limits. In particular, when the diameter of the piston comprises D mm, the amount of hydraulic which is displaced when the piston moves over its maximum stroke is preferably comprised between 1.0×D ml and 3.0×D ml. This amount is more preferably larger than 1.5×D ml and preferably smaller than 2.5×D ml.

For a given diameter D of the piston, the amount of liquid displaced by the piston is determined by the maximum stroke of the piston. This maximum stroke is reduced by the reduction gearing between the pushrod 10 and the piston 22. The gear ratio of this reduction gearing is therefore preferably selected so that the amount of hydraulic liquid displaced is within the above described ranges. This gear ratio is in particular preferably selected so that the distance over which the piston 22 reciprocates is at least 1.5, preferably at least 1.9 and more preferably at least 2.2 times smaller than the distance over which the pushrod 10 reciprocates.

When a smaller amount of liquid is displaced upon one maximum stroke of the piston 22, the restricted fluid passages can be made smaller so that a more effective compensation of temperature variations can be obtained. The amount of liquid which is displaced is however preferably larger than a minimum amount. In this way, the stroke of the piston can be also be larger, which is advantageous especially in case a further restricted fluid passage 31 should be provided to be able to control the final closing speed, and also the clearance 43 between the piston and the wall of the cylinder cavity may be larger which enables to produce the cylinder cavity, for example by cutting, with larger tolerances.

EXAMPLE

Dimensions

The closing device illustrated in the drawings has for example the following specific dimensions:

| | |
|---|---|
| Maximum stroke of pushrod 10: | 160 mm |
| Pitch diameter of first pinion 39: | 30 mm |
| Pitch diameter of gear 38: | 57 mm |
| Pitch diameter of second pinion 35: | 24 mm |
| Gear ratio: | 0.42 (=24 mm/57 mm) |
| Maximum stroke of piston 22: | 67 mm (=160 mm × 0.42) |
| Diameter of piston 22: | 38 mm |
| Liquid displace upon maximum stroke: | 76 ml |
| Width of clearance 43 around piston 22 at 20° C.: | 0.04 mm |

Although the present invention has been described with reference to specific exemplary embodiments, it will be evident that various modifications and changes may be made to these embodiments without departing from the broader scope of the invention as set forth in the claims. Accordingly, the description and drawings are to be regarded in an illustrative sense rather than a restrictive sense.

The invention claimed is:

1. A device for closing a closure member hinged on a support, which closing device comprises an actuator mechanism having a resilient member which is arranged to urge the hinged closure member towards its closed position and a hydraulic damper mechanism for damping the closing movement of said hinged closure member under the action of said resilient member, which actuator mechanism comprises:

a frame;

a reciprocating pushrod which is slidably mounted on said frame to translate between an extended and a retracted position when opening and closing the hinged closure member; and said resilient member which is arranged between said pushrod and said frame to urge the pushrod towards its extended position, and which hydraulic damper mechanism comprises:

a cylinder barrel defining a closed cylinder cavity;

a reciprocating piston placed within said cylinder barrel so as to divide the cylinder cavity into a first side and a second side;

a first motion converting mechanism for converting the translational motion of said pushrod into a rotational motion of a first pinion, which first motion converting mechanism comprises a first rack and pinion gearing having a first rack on said pushrod which engages said first pinion;

a transmission, including a second motion converting mechanism, between said first pinion and said piston for transmitting and converting the rotational motion of said first pinion into a translational motion of the piston;

a one-way valve allowing fluid flow from said first side to said second side of the cylinder cavity when opening the hinged member; and at least one restricted fluid passage between said first and second sides of the cylinder cavity, wherein:

the hydraulic damper mechanism comprises a piston rod fixed to said piston to reciprocate together with the piston in the cylinder cavity;

said second motion converting mechanism comprises a second rack and pinion gearing arranged within said cylinder cavity and having a second rack formed by said piston rod and a second pinion engaging said second rack; and said transmission provides together with said first and second a reduction gearing between said pushrod and said piston so that said piston reciprocates over a smaller distance than said pushrod.

2. A closing device according to claim 1, wherein at least at 20° C., said piston has a diameter which is smaller than the diameter of said cylinder cavity at the location of the piston so that a clearance is present between the piston and an inner surface of the cylinder barrel, said at least one restricted fluid passage comprising said clearance.

3. A closing device according to claim 2, wherein said cylinder barrel is made of at least a first material and the piston of at least one second material which is selected to have such a thermal expansion coefficient, different from the thermal expansion coefficient of said first material, that the surface area of said clearance decreases when the temperature of the damper mechanism increases from 20° C. to 30° C. and increases when the temperature of the damper mechanism decreases from 20° C. to 10° C.

4. A closing device according to claim 1, wherein said first motion converting mechanism is arranged outside the closed cylinder cavity.

5. A closing device according to claim 1, wherein said transmission comprises a rotary shaft which enters said closed cylinder cavity in said first side thereof.

6. A closing device according to claim 5, wherein said second pinion is provided on said rotary shaft.

7. A closing device according to claim 5, wherein said rotary shaft is provided outside the closed cylinder cavity with a first gear which has a pitch diameter which is larger than the pitch diameter of said second pinion.

8. A closing device according to claim 7, wherein said first gear is different from said first pinion and is coupled thereto, the first gear preferably engaging said first pinion.

9. A closing device according to claim 1, wherein said reduction gearing has such a gear ratio that the distance over which said piston reciprocates is at least 1.5 times smaller than the distance over which said pushrod reciprocates.

10. A closing device according to claim 1, wherein said piston has a diameter which is larger than 20 mm.

11. A closing device according to claim 1, wherein said piston has a diameter which is smaller than 70 mm.

12. A closing device according to claim 1, wherein said reciprocating pushrod is slidably mounted on said frame between two extreme positions determining a maximum stroke of the pushrod and said reduction gearing has such a gear ratio that when the pushrod is moved over its maximum stroke the amount of hydraulic liquid displaced by the piston is comprised between 1.0×D ml and 3.0×D ml, which amount is preferably larger than 1.5×D ml and smaller than 2.5×D ml, with D being the diameter of the piston in mm.

13. A closing device according to claim 1, wherein said cylinder barrel is made of extruded aluminium and comprises at least one non-circular longitudinal through hole which is arranged to receive said second rack.

14. A closing device according to claim 1, wherein the frame of the actuator mechanism comprises a first hinge part arranged to be hinge connected to one of said hinged member and said support and the pushrod comprises a second hinge part arranged to be hinge connected to the other one of said hinged member and said support.

15. A closing device according to claim 1, wherein said resilient member comprises a helical spring.

16. A closing device according claim 1, wherein the closing device comprises a main body which is made in one piece of an extruded aluminium profile and which forms a portion of the frame, of the hydraulic damper mechanism and a portion of the actuator mechanism.

17. A closing device according to claim 16, wherein the cylinder cavity is cut in said piece of extruded aluminium profile.

* * * * *